United States Patent [19]

Munoz

[11] Patent Number: 4,861,078

[45] Date of Patent: Aug. 29, 1989

[54] OVEN DOOR LATCH WITH HANDLE STABILIZER

[75] Inventor: Jose Munoz, Kensington, Conn.

[73] Assignee: The Stanley Works, New Britain, Conn.

[21] Appl. No.: 99,610

[22] Filed: Sep. 22, 1987

[51] Int. Cl.[4] ..... E05C 5/00

[52] U.S. Cl. ..... 292/113; 292/DIG. 69

[58] Field of Search ..... 292/113, DIG. 69; 126/197

[56] References Cited

U.S. PATENT DOCUMENTS

| | | | |
|---|---|---|---|
| 3,410,591 | 11/1968 | Fowler | 292/DIG. 69 |
| 3,438,666 | 4/1969 | Erickson | 292/DIG. 69 |
| 3,476,424 | 11/1969 | Erickson | 292/DIG. 69 |
| 3,540,767 | 11/1970 | Siegel | 126/1974 |
| 3,750,643 | 8/1973 | Fowler | 292/DIG. 69 |
| 3,831,580 | 8/1980 | McLean | 126/197 |
| 3,859,979 | 1/1975 | Gilliom | 126/197 |
| 4,013,312 | 3/1977 | DeWeese | 292/113 |
| 4,133,337 | 1/1979 | Shea | 292/113 |
| 4,163,443 | 8/1979 | Peterson | 292/DIG. 69 |
| 4,174,860 | 11/1979 | Shea | 292/113 |
| 4,364,589 | 12/1982 | Watson | 126/197 |
| 4,593,945 | 6/1986 | Arute et al. | 292/216 |

*Primary Examiner*—Gary L. Smith

*Assistant Examiner*—Eric K. Nicholson

[57] ABSTRACT

A latch for an appliance door has a support member adapted to be mounted within the appliance, and a latch assembly movable on the support member between latching and unlatching positions. The latch assembly includes a bracket member, a pivotal mounting between the bracket member and the support, an elongated operating handle affixed to the bracket member, a latch arm for locking a door having a slot about the pivotal mounting whereby the latch arm may have rotational and translational motion with respect to the pivotal mounting. A toggle arm is pivotally connected at one end thereof to the bracker member and at the other end thereof to the latch arm, and a spring is connected between one end of the toggle arm and the support member whereby, upon operation of the handle from an unlatched to a latched position, the latch arm is moved to a position to latch the door and the spring holds the assembly in a stable condition. An arcuate slot is defined in the support member beneath the bracket member, and a pin extending from the bracket member has a recess intermediate the ends thereof defining shoulders which closely overlie the edges of the member defining the arcuate slot whereby the pin prevents the bracket and handle thereon from rocking movement in the direction of the longitudinal axis of the pin.

3 Claims, 2 Drawing Sheets

OVEN DOOR LATCH WITH HANDLE STABILIZER

FIELD OF THE INVENTION

This invention relates to latches for appliances such as pyrolytic ovens and my also be used in doors for other appliances such dishwashers.

BACKGROUND OF THE INVENTION

Pyrolytic or so-called self-cleaning ovens are provided with a thermostatically controlled latch which prevents opening of the oven door while it is in a self-cleaning mode of operation at high temperatures, which may be on the order of eight hundred degrees Fahrenheit. Such a latch generally comprises a latching mechanism disposed within the housing of the oven and a latch which engages an opening on the door of the oven when a handle is operated to move the latch to its latching position.

The handle utilized by the operator to latch the door is attached to an operating lever having a free end extending outwardly of the appliance. The oven latching mechanism includes a thermostatic element generally in the form of a spiral bimetallic strip which will move a blocking pawl to a position which blocks release of the latch until the oven has cooled to a predetermined temperature after a self-cleaning cycle of operation.

Prior oven door latches as well as dishwasher door latches do not provide for stabilization of the operating handle to prevent rubbing of the handle on range surfaces through which the handle protrudes. In time, such rubbing may cause scraping of paint or scratching of metallic porcelainized or enamelled finished detracting from the appearance of the appliance.

Accordingly, it is an object of the present invention to provide a new and improved structure for stabilizing the operating handle of a pyrolytic or self-cleaning oven, or other appliance to limit any vertical movement of the handle and prevent rubbing ofthe operating handle on the appliance surface thereabout.

A specific object of this invention is to provide a new and improved latch for an appliance door which has no vertical rocking movement which would mar the appearance of the front of the appliance.

SUMMARY OF THE INVENTION

Briefly stated, the invention in one form thereof is embodied in a latch for an appliance door includng a support member adapted to be mounted within the appliance, and a latch assembly movable on the support member between latching and unlatching positions. The assembly comprises a bracket member, a pivotal mounting between the bracket member and the support, an alongated operating handle affixed to the bracket member, and a latch arm for locking an appliance door having a slot about the pivotal mounting whereby the latch arm may have rotational and tanslational motion with respect to the pivotal mounting. A toggle arm is pivotally connected at one end to the bracket member and at the other end to the latch arm, and a spring is connected between one end of the toggle arm and the support member whereby, upon operation of the handle from an unlatched to a latched position, the latch arm is moved to a position to latch the door and the spring holds the assembly in a stable condition. An arcuate slot is defined in the support member beneath the bracket member, and a pin extending from the bracket member has a recess intermediate the ends thereof defining shoulders which closely overlie the edges of the member defining the arcuate slot whereby the pin prevents the bracket and handle thereon from rocking movement in the direction of the axis of the pin.

DETAILED DESCRIPTION OF THE PREFERRED EMBODIMENT OF THE INVENTION

Figure 1:
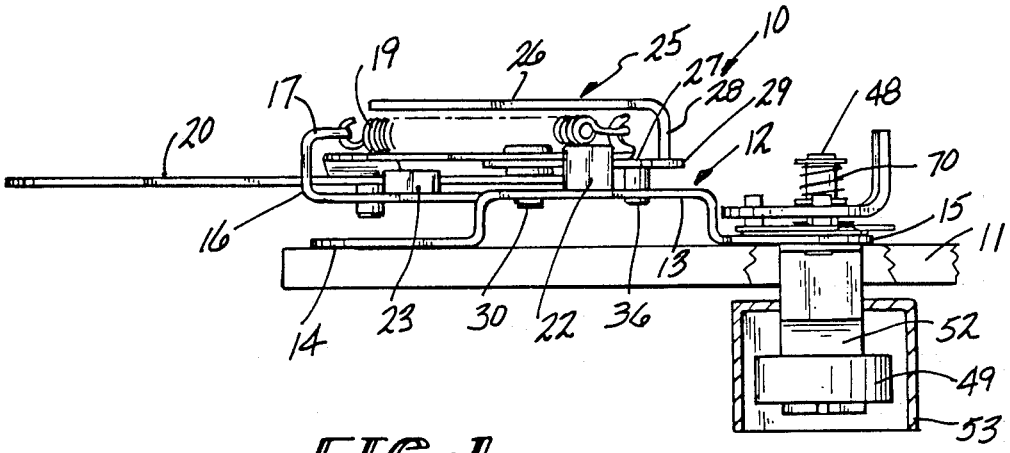
FIG. 1 is a side elevational view of an oven latch assembly embodying the invention with the handle removed, a portion shown in half section, and with a portion of the oven housing being fragmentarily illustrated.
Figure 2:
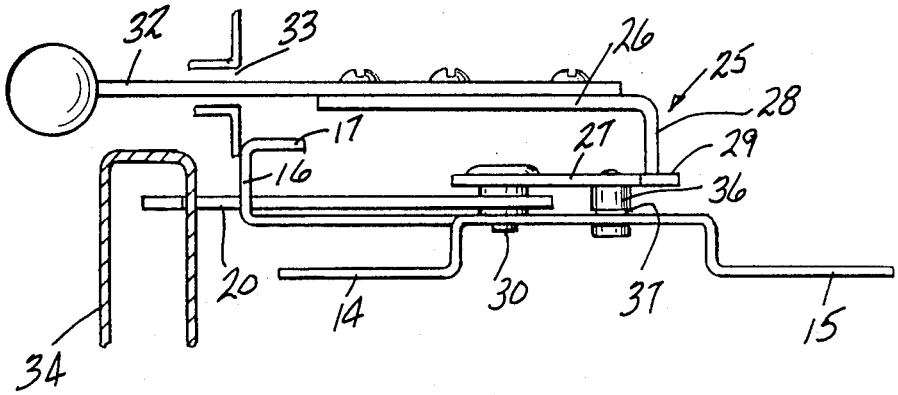
FIG. 2 is an enlarged side elevational view similar to FIG. 1, but with some parts removed and with the operating handle attached.
Figure 3:
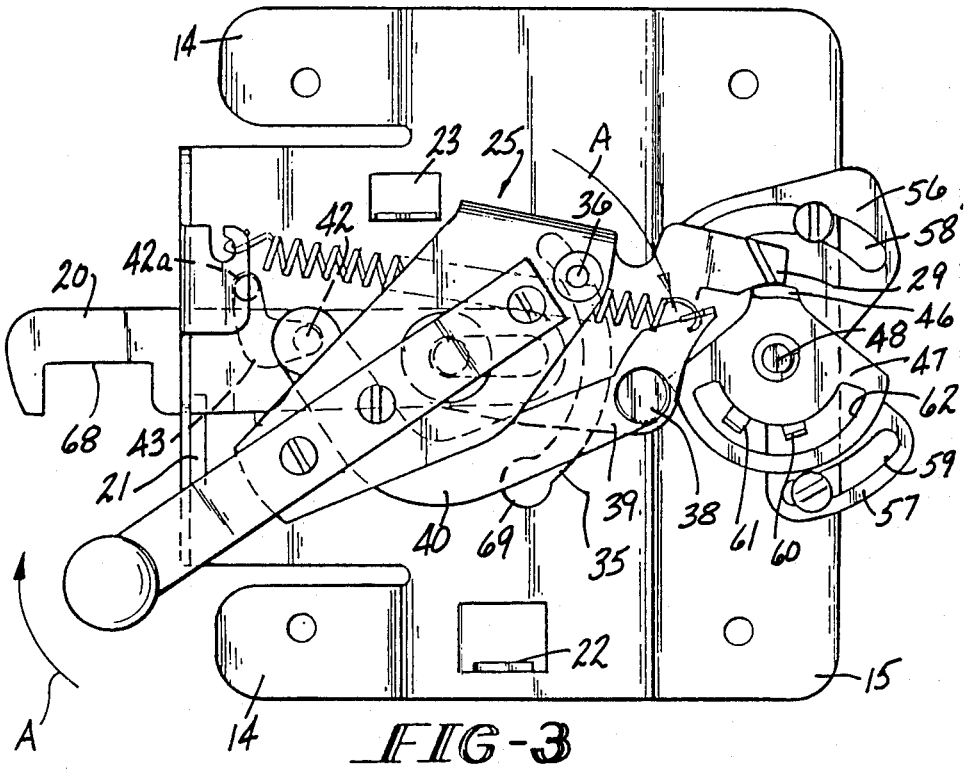
FIG. 3 is a top plan view of the mechanism of FIG. 1 showing the latch in a latched position and blocked from opening.
Figure 4:
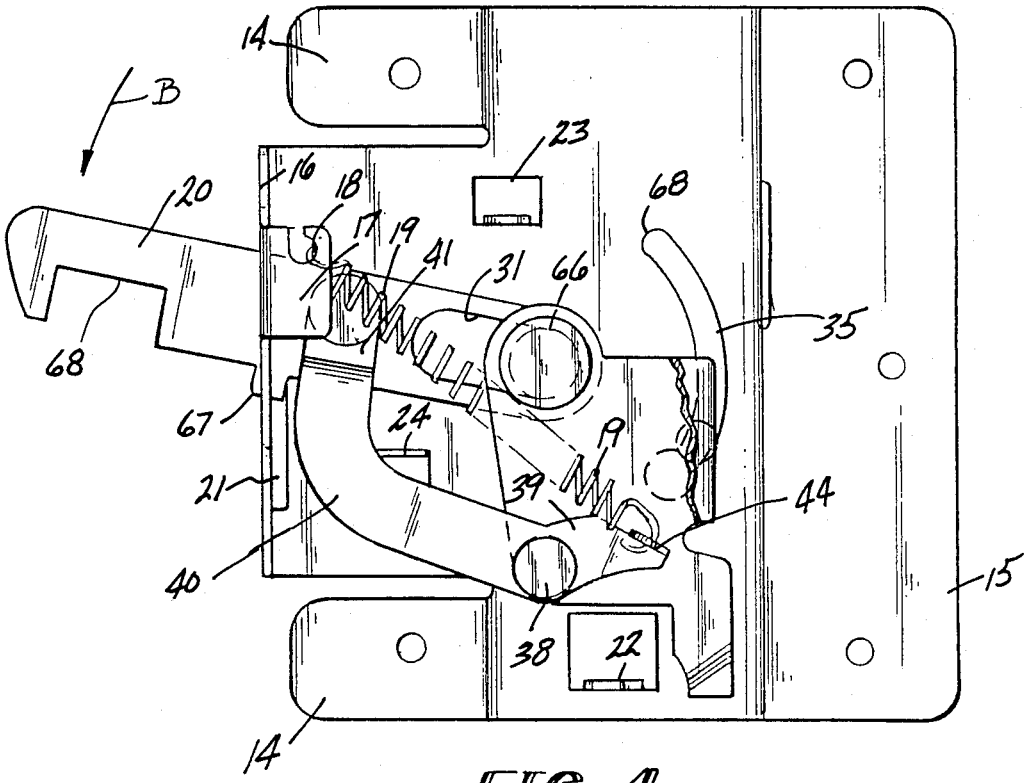
FIG. 4 is a view similar to FIG. 3, but with the latch in an unlatched position and with parts removed for clarity of illustration.

Referring now to FIGS. 1 and 2, a latching mechanism generally designated by the numeral 10 embodying the invention is mounted to fragmentally illustrated horizontal wall 11 of the appliance. As is customary, the wall 11 is spaced above the oven cavity (not shown). The latching mechanism comprises a support plate generally designated by the numeral 12 which is secured to wall 11 by a plurality of fasteners (not shown). Support plate 12 is stamped or otherwise formed to provide an elevated platform portion 13 essentially parallel to and spaced from wall 11. At each end are depending L-shaped spaced apart flange 14 and flange 15. On the latch side of the mechanism, is an upstanding wall 16 with a finger 17 which provides an anchor 18 (not shown in FIG. 1) for one end of a spring 19. A latch arm 20 extends through an elongated slot 21 in wall 16 (FIGS. 3 and 4). The platform portion 12 is staked upwardly to provide upstanding abutments 22, 23, and 24 (FIG. 4) to limit movement of parts as hereinafter described. Disposed upon platform 12 is a bracket generally designated by the numeral 25 of generally U-shaped configuration, with an upper wall 26, a lower wall 27, and an interconnecting wall 28. The lower wall 27 includes an integral projecting arm 29. The lower wall 27 is pivotally mounted to platform 13 by a pin 30 which extends through an elongated slot 31 in latch arm 20 (FIG. 4) and provides a pivotal mounting of bracket 25 to support 12.

As shown in FIG. 2, an elongated operating handle 32 is attached to upper wall 26 of bracket 25 and extends through an opening 33 in the front wall 11 of the appliance. The latch arm 20 is shown in a latched postion engaging door 34 of the appliance.

Reference is now made to FIG. 3 in conjunction with FIG. 2. Defined in platform 13 is an arcuate slot 35 which receives a pin 36 which has a reduced cross section intermediate the ends, as exemplified by the reference numeral 37, so that is provides shoulders which overlies the edges defining slot 35 and prevents any rocking motion of bracket 25 and handle 32.

Pivotally connected to lower wall member 27 of bracket 25 by a pin 38 is one end 39 of a toggle arm 40

(FIG. 4). The other end 41 of toggle arm 40 is pivotally connected to latch arm 20 by a pin 42 which extends into a cam slot 43. Spring 19 has its other end connected to an upstanding finger 44 on toggle arm 40.

As shown in FIGS. 2 and 3, latch arm 20 is in a latching position and blocked from unlatching. As will be noted in FIG. 3, projecting arm 29 of member 25 is engaged by an upstanding abutment or dog 46 of a blocking pawl 47 which is mounted on a rotatable shaft 48. A coiled bimetallic strip 49, (FIG. 1) has its inner end (not shown) secured to shaft 48 and its outer end (not shown) to a bracket 52. A housing member 53 with a lower opening surrounds strip 49. Shaft 48 extends through flange 15 of support plate 12 to the bimetallic strip 49. Bracket 52 is of L-shape with a further depending flange (not shown) which anchors the outer end of strip 49, and is secured to flange 15 of support member 12. Adjustably mounted to flange 15 are adjustment members 56 and 57 having arcuate slots 58 and 59, respectively. Adjustment member 58 carries an upstanding stop 60 and adjustment member 57 carries an upstanding stop 61. These stops extend into an arcuate slot 62 defined in pawl 47, and the members 56 and 57 are adjustable to determine the limits of rotation of pawl 47 on shaft 48. The adjustment members 56 and 57 are pivotable about shaft 48.

FIG. 3 ilustrates the latch in a latched and blocked position during a self-cleaning operation of the oven, where the dog 46 on pawl 47 blocks the arm 29 and prevents the mechanism from being unlatched. As shown in FIG. 3, bracket 25 has not moved to its fully latched position, at which point the lower wall 27 would engage abutment 23, but is shown in a position where attempt is being made to unlatch, as indicated by the arrow A.

Abutment 24 will engage a finger 67 on latch arm 20 and prevent inward movement of latch arm 20 on a bushing 66 about pivot pin 30 if latch arm does not engage the door 34.

Reference is now made to FIG. 4, which shows the mechanism with portions thereof removed in a top plan view when the mechanism is in an unlatched position. Latch arm 20 has an elongated slot 31 which receives therein bushing 66 on pin 30. It will further be noted that spring 19 is in a different position than shown in FIG. 3. As shown in FIG. 3, pin 42 on toggle arm 40 is in the latched condition, and, in the unlatched condition of FIG. 4, pin 42 will be positioned as shown in dotted line 42a in FIG. 3 within cam slot 43. When it is desired to latch the oven door, the latch 20, through the handle 31 and bracket 25, will be rotated in the direction of the arrow B in FIG. 4. When the cut-out 68 in latch arm 20 engages a strike plate (not shown) on the oven door (not shown), motion of the latch arm 20 will be halted. Further rotation of handle 32 will then cause latch arm 20 to move on bushing 66 in elongated slot 31 inwardly and the latch arm 20 will pull the oven door 34 in tightly to close the opening to the oven. As this occurs, spring 19 moves over center past pin 30 to the position shown in FIG. 3, over center toggle action occurs and the latching mechanism moves to a stable position.

The pawl 47 may rotate with respect to shaft 48. This might occur if the bimetallic strip 49 rotates shaft 48 until the pawl 47 strikes one of the stops 60 or 61 and the bimetallic coil continues to expand or contract. To accommodate such movement, pawl 47 is connected to shaft 48 by means of a clutch spring 70 (FIG. 1). The spring has suffcient tension so that shaft 48 may drive pawl 47 but will permit slippage therebetween if the pawl moves to one of its limits determined by the stops 60 and 61.

The arcuate slot 35 and pin 36 serve a dual function. The end 68 of slot 35 defines the limit of travel of bracket 25 in a latched condition, and the recess 37 in pin 36 permits the shoulders defining recess 37 in pin 36 to overlie both sides of platform 13 defining arcuate slot 35 and prevent any rocking motion of bracket 25 and handle 32 in the direction of the axis of the pin. Slot 35 terminates in an elarged open end 69 which initially receives pin 36 during assembly of bracket 25 to base 12. Once assembled, pin 36 will never again reach open end 69 since pin 42 in cam slot 43 will limit the travel of bracket 25 in the unlatched position so that pin 36 will never go beyond the position shown in FIG. 4. At this time, pin 42 will be in the position shown at 42a in cam slot 43 in FIG. 3.

It may thus be seen that the objects of the invention set forth, as well as those made apparent from the foregoing description, are efficiently attained. While a preferred embodiment of the invention has been set forth for purposes of disclosure, modifications to the disclosed embodiment of the invention, as well as other embodiments thereof, may occur to those skilled in the art. Accordingly, the appended claims are intened to cover all embodiments of the invention and modifications to the disclosed embodiment which do not depart from the spirit and scope of the invention.

Having thus described the invention, what is claimed is:

1. A latch for an appliance door comprising a support member adapted to be mounted within the appliance; and a latch assembly movable on said support member between latching and unlatching positions, said assembly comprising a bracket member, a pivot member pivotally mounting said bracket member on said support member, an elongated operating handle affixed to said bracket member, a latch arm for locking the associated applicance door and having a slot through which said pivot member extends whereby said latch arm may have rotational and translational motion with respect to said pivot member, a toggle arm pivotally connected at one end thereof to said bracket member and at the other end thereof to said latch arm, a spring connected between said one end of said toggle arm and said support member whereby, upon operation of said handle on said bracket member to move said latch assembly from an unlatched to a latched position, said latch arm is moved to a position to latch the associated door and said spring holds said assembly in a stable latched position, said support member having an arcuate slot therein beneath said bracet member, said assembly also including a pin on said bracket member extending through said slot, said pin being of greater cross section than said slot and having a reduced cross sectional groove cooperatively configured and dimensioned to permit sliding movement of said pin in said slot and defining upper and lower shoulders above and below said support member which closely overlie the surfaces of said support member defining said arcuate slot, whereby said pin is prevented from any substantial rocking movement transversely of said slot and thereby prevents said bracket and handle thereon from rocking movement about the longitudinal axis of said pin.

2. The latch of claim 1, wherein one end of said arcuate slot is at the end of travel of said pin when said latch arm is moved to a latching position, wherein the other end of said arcute slot is enlarged to permit entry of said pin into said arcuate slot upon assembly of said bracket to said support member, and wherein there are included cooperating means on said latch arm and said support memeber for limiting movement of said pin to said enlarged end of said arcuate slot when said handle is moved to an unlatched position.

3. The latch of claim 2, wherein said cooperating means is a pin on said latch arm extending through an opening in said support member.

* * * * *